US005314014A

United States Patent [19]

Tucker

[11] Patent Number: 5,314,014

[45] Date of Patent: May 24, 1994

[54] PACKER AND VALVE ASSEMBLY FOR TEMPORARY ABANDONMENT OF WELLS

[75] Inventor: Andrew J. Tucker, Tulsa, Okla.

[73] Assignee: Dowell Schlumberger Incorporated, Sugar Land, Tex.

[21] Appl. No.: 883,632

[22] Filed: May 4, 1992

[51] Int. Cl.[5] ..... E21B 33/12; E21B 34/12

[52] U.S. Cl. ..... 166/124; 166/139; 166/188; 166/242; 166/330; 166/334

[58] Field of Search ..... 166/330, 334, 242, 124, 166/139, 188, 73

[56] References Cited

U.S. PATENT DOCUMENTS

| | | | |
|---|---|---|---|
| 2,507,262 | 5/1950 | McGivern | 166/124 X |
| 2,942,665 | 6/1960 | Davis et al. | 166/124 |
| 3,461,962 | 8/1969 | Harrington | 166/330 |
| 3,643,737 | 2/1972 | Current et al. | 166/139 X |
| 4,313,497 | 2/1982 | Graham | 166/330 X |
| 4,871,018 | 10/1989 | Caskey et al. | 166/188 X |
| 5,154,228 | 10/1992 | Gambertoglio et al. | 166/124 |

*Primary Examiner*—Hoang C. Dang
*Attorney, Agent, or Firm*—Stephen A. Littlefield

[57] ABSTRACT

Preferential disconnection of a valve-actuating subassembly from a temporary abandonment safety valve and packer assembly is provided by stops which limit relative rotation between the valve-actuating subassembly within the valve along with a locking collar associated with the interconnection between the safety valve and the packer assembly so that high torque associated with rotational movement of a drill string in a highly deviated hole effects the release of the proper portion of the assembly without danger of undesirable release of other interconnections.

9 Claims, 3 Drawing Sheets

PACKER AND VALVE ASSEMBLY FOR TEMPORARY ABANDONMENT OF WELLS

This invention relates to the art of hydrocarbon production f rom subterranean formations located under bodies of water and, more particularly, to a packer and valve assembly for temporarily abandoning operations in wells penetrating the subterranean formation.

BACKGROUND OF THE INVENTION

Much of the world's hydrocarbon resources are located in subterranean formations below bodies of water. By their very nature, well drilling and other well operations conducted from a platform located in a body of water present specialized dangerous conditions not present in drilling and other well operations conducted on land. In particular, severe weather conditions such as severe storms and hurricanes present an extreme danger to the continued conduct of well operations at sea.

Under severe weather conditions, it is typical to temporarily abandon well operations by disconnecting drill pipe or well tubing from the well bore and shutting in the well until the weather danger subsides at which time the well can be reentered and operations may continue. In this regard, drilling operations can be temporarily suspended leaving drill pipe in the hole through the use of a specially designed packer and valve assembly for temporary abandonment.

In order to temporarily abandon and shut in a well, a portion of the drill pipe in the hole is withdrawn and the packer and valve assembly are attached to a section of the drill pipe and lowered into the well to pack off the well and upper section of casing, typically at a depth of 100' to 300' below the wellhead. Once the packer is set, the associated valve assembly is activated by removing a subassembly of the valve which effects the closing of the valve and the disconnection of the subassembly and drill pipe above the packer so that it can be withdrawn from the well during periods of severe weather danger. The packer and valve assembly remains in the well with the drill pipe below the packer remaining attached to the packer and valve assembly thereby avoiding the lengthy process of removing multiple joints of pipe. Once the packer and valve assembly is in place and the valve-actuating subassembly is removed and withdrawn from the well, the blowout preventers at the wellhead can be activated to provide additional safety and blowout protection during the period of temporary abandonment.

A difficulty presents itself in this scheme in that all of the threaded interconnection of drill pipe, packer assembly, valve assembly and valve-actuating subassembly comprise threaded connectors requiring generally right hand torque in the make-up of the overall assembly. Furthermore, the setting of the packer typically requires the application of right hand torque while decreasing the weight of the drill string below the packer holding right hand torque. In highly deviated or horizontal wells where there is a large component of friction against the drill string, extremely high amounts of right hand torque are often necessary to set the packer. This right hand torque is also transferred through each of the threaded interconnections between the drill pipe, the packer assembly, the valve assembly and the valve-actuating subassembly. With this overtorquing of all of these threaded connections, it is impossible to predict which of the connections will "break" when opposite, left hand torque is applied preferably for the purpose of removing the valve-actuating subassembly from the valve assembly. Instead of effecting the desired rotational disconnection of the valve-actuating subassembly, the disconnection of the threaded interconnection between the packer assembly and the valve assembly often occurs thereby causing the failure of the temporary abandonment system to close off the well as desired.

SUMMARY OF THE INVENTION

The present invention provides a means of interconnecting the packer, the valve assembly and the valve-actuating subassembly which promotes and permits only the valve-actuating subassembly to be removed by opposite rotation as desired.

In accordance with the invention, an improved packer assembly for temporary abandonment of a well, which assembly is set by rotation in a first direction and released by rotation in a second direction opposite to said first direction, the packer assembly including a threaded connector mandrel having threads in a first thread hand and a threaded connector means for connecting the threaded connector mandrel of the packer assembly to a valve assembly having matching threads in the first thread hand, the improvement which comprises groove means for receiving a retainer ring on an outer cylindrical surface of the mandrel, a retainer ring within the groove and extending radially outwardly into compressive engagement with locking collar means having threads of a second thread hand opposite to the first hand in coupling engagement with matching threads of the second thread hand of the connector means.

Further in accordance with the invention, a valve assembly for the temporary abandonment of a well which well assembly comprises a lower valve portion and a threaded valve-actuating subassembly maintaining the lower valve portion in an open position when the threaded valve-actuating subassembly is in place and allowing the lower valve portion to move into a closed position upon rotation in a first removal direction to remove the threaded valve-actuating subassembly, the improvement which comprises stop means on the threaded valve-actuating subassembly and the lower valve portion, the stop means limiting relative rotation of the valve-actuating subassembly and the lower valve portion in a second, make-up rotational direction.

Further in accordance with the invention, the above-described improved packer assembly and the above-described improved valve assembly are combined in a single well tool.

It is therefore an object of this invention to provide a connector assembly between a temporary abandonment packer and a temporary abandonment valve which locks against disconnecting rotational movement within the well bore and until such disconnection may be desired.

It is a further object of this invention to limit the transfer of torque and tightening engagement between a valve-actuating subassembly of a temporary abandonment valve so that disconnecting rotation preferentially breaks the connection at the desired threaded interconnection between the valve-actuating subassembly and its related lower valve portion.

BRIEF DESCRIPTION OF THE DRAWINGS

These and other objects of the invention are accomplished through the manner and form of the present invention to be described in greater detail hereinafter and in conjunction with the accompanying drawings forming a part of this specification in which.

DETAILED DESCRIPTION OF THE PREFERRED EMBODIMENTS AND THE DRAWINGS

The invention will now be described in the more limited aspects of a preferred embodiment thereof including a detailed description of parts and arrangements of parts. Such description shall in no way limit the scope of this invention.

Figure 1:
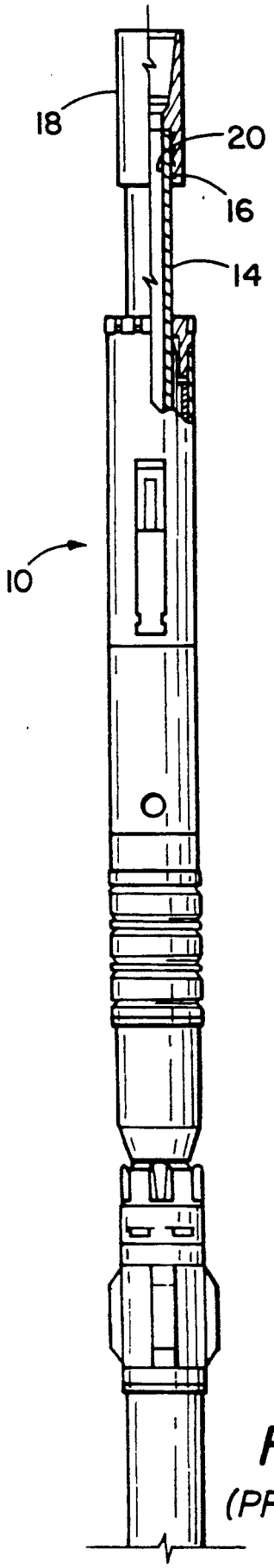
Fig. 1 (PRIOR ART)
FIG. 1 is a side elevational view in partial cross section of a prior art packer for temporary abandonment.
Figure 2:
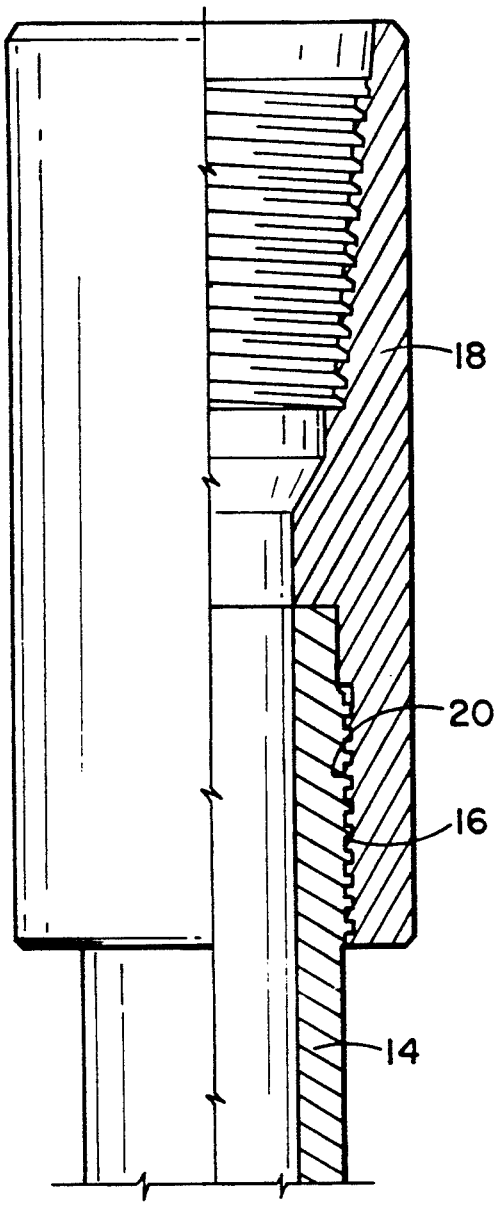
Fig. 2 (PRIOR ART)
FIG. 2 is an enlarged, side elevational view in partial cross section of a prior art connector assembly for the prior art packer shown in FIG. 1.
Figure 4:
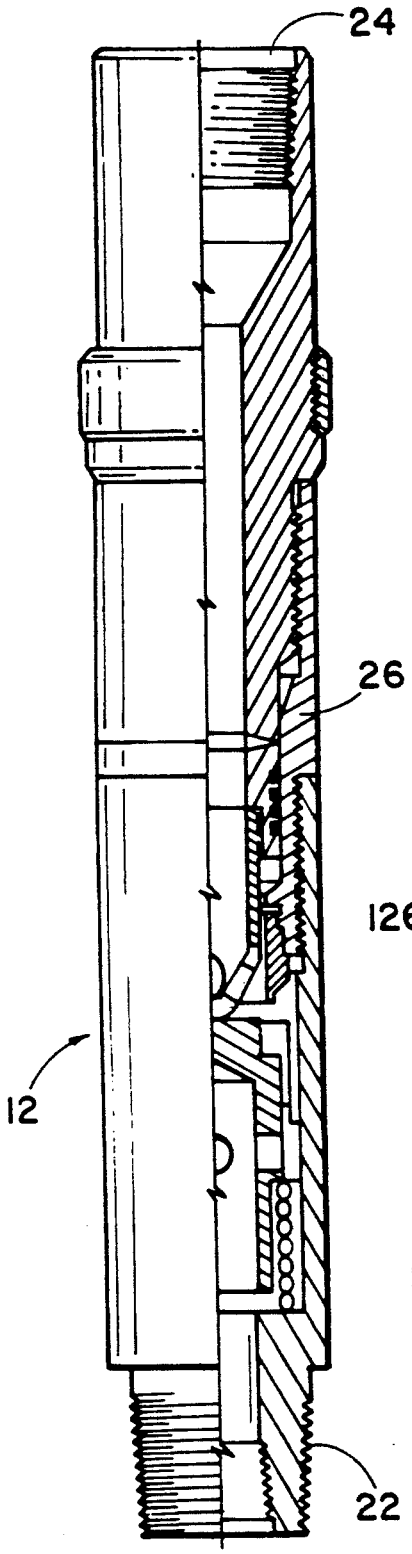
Fig. 4 (PRIOR ART)
FIG. 4 is a side elevational view in partial cross section of a prior art temporary abandonment safety valve which is used in conjunction with the packer and connector assembly shown in FIGS. 1 through 3.

In a packer and valve system for temporary abandonment of a well, a packer assembly 10 (FIG. 1) is attached to a drill pipe string (not shown) and to a temporary abandonment safety valve 12 (FIG. 4). In order to effect the interconnection between the packer assembly 10 and the safety valve 12, the packer assembly 10 includes a connector mandrel 14 (FIGS. 1 and 2) having a threaded outer surface 16. A coupling member 18 having matching internal threads 20 is rotated into tight connection on the connector mandrel 14. The coupling member 18 is then threadably interconnected with a threaded connector portion 22 of the temporary abandonment safety valve 12 (FIG. 4). In all cases, the aforementioned threaded interconnections include threading in the same direction, typically right handed. The temporary abandonment safety valve 12 then interconnected at its top connector 24 to a length of drill pipe (not shown) and lowered into the well bore for seating in an upper portion (typically the first 100' to 300') of the top casing. Top connector 24 of the temporary abandonment safety valve 12 also incorporates threading in the same direction as the threads of the aforementioned components, again, typically right hand thread.

The packer can be set in the hole by the application of right hand rotation which causes the engagement of packer slips and elastomeric packer elements with the casing to effect a seal as is well known in the art. Such packer setting operation typically involves a number of rotations of the drill string in order to effect setting of the packer. Difficulty arises with the prior art devices, however, when attempting to rotate a long drill string in a deviated or horizontal hole. A large amount of torque is required to overcome the frictional drag forces associated with the drill string engaging portions of the bore hole and/or casing. This high torque is translated into torque tightening of all of the threaded interconnections between the packer assembly 10 and its connector mandrel 14 with the coupling member 18, the temporary abandonment safety valve 12 and the top connector 24.

This high torque loading is also translated to the valve-actuating subassembly 26 of the temporary abandonment safety valve which also includes a right hand threaded interconnection within the safety valve 12. In order to close the safety valve for temporary abandonment of the well, it is necessary to disconnect the valve-actuating subassembly 26 from the temporary abandonment safety valve 12 by rotating the valve-actuating subassembly 26 out of its threaded engagement in the safety valve 12. Because of the high stored torque loadings in all of the aforementioned threaded interconnections, it cannot be reliably predicted which of the threaded interconnections will "break" in order to allow rotating disconnection of the assembly. Desirably, only the valve-actuating subassembly 26 would release and rotate to activate valve closure. However, in practice, especially with the aforementioned conditions involving long drill strings in highly deviated or horizontal holes, the connection that often releases is between the connector mandrel 14 and the coupling member 18. It is this problem which the present invention addresses.

Figure 3:
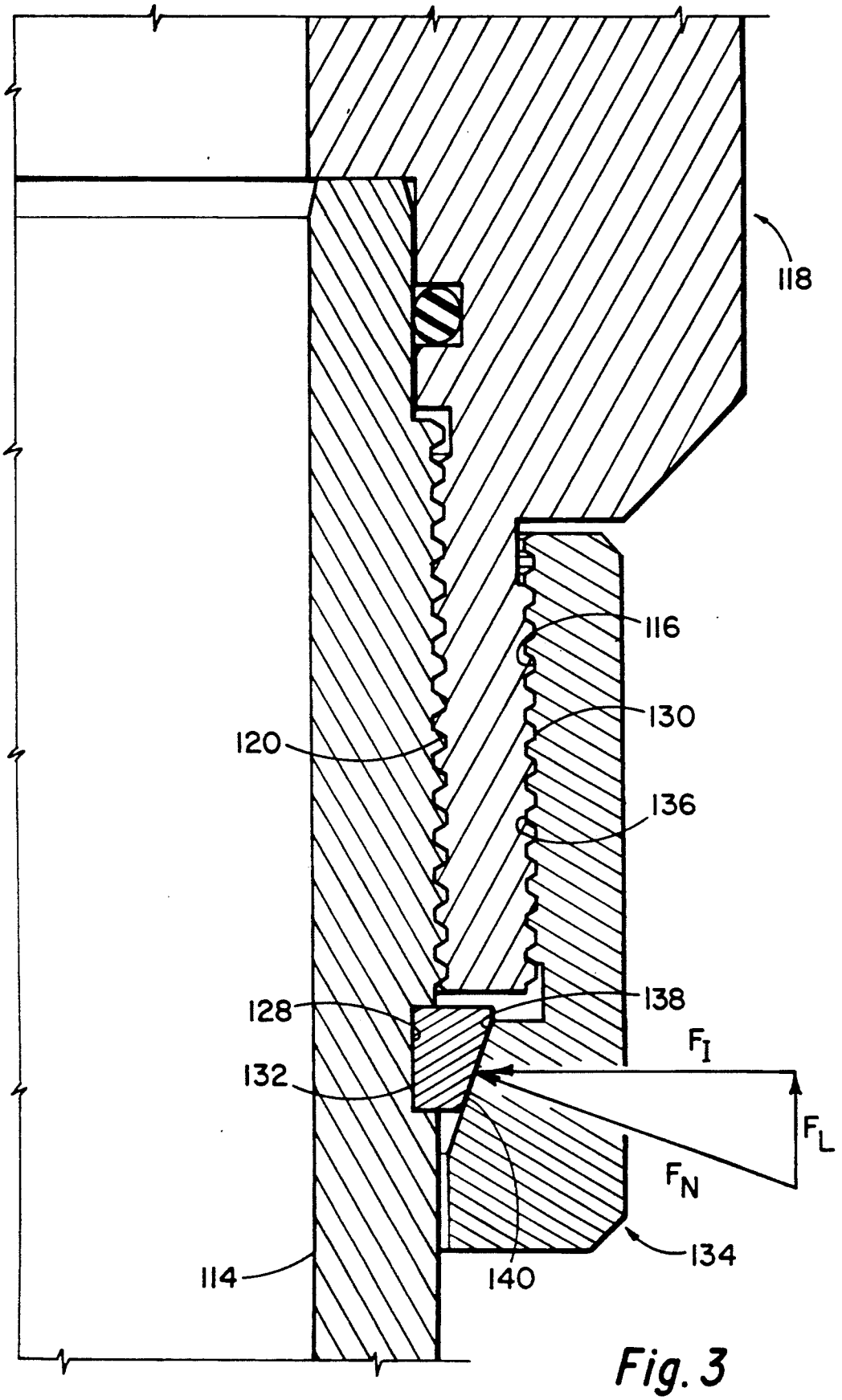
FIG. 3 is a cross-sectional view of a connector assembly in accordance with the present invention illustrating the improvement over the connector assembly shown in FIG. 2.

In accordance with one aspect of the invention as shown in FIG. 3, a connector mandrel 114 attached to a packer assembly (not shown) as previously described includes a threaded outer surface 116 having right hand threads. A circumferential groove 128 is also provided in the outer surf ace of the connector mandrel 114. A coupling member 118 including matching internal threads 120 further includes external threads 130 of the opposite hand, in this instance, left hand threads.

Further in accordance with the invention, a split ring 132 is located within the circumferential groove 128 of the connector mandrel 114. A locking collar 134 having internal threads 136 in engagement with the external threads 130 of the coupling member 118 is provided. An abutment surface 138 of the locking collar 134 is in compressive engagement with an outwardly facing surface 140 of the split ring 132. In operation, the left hand rotational movement which would tend to disconnect the threaded interconnection between the connector mandrel 114 and the coupling member 118 would be resisted by a buildup of compressive force between the abutment surface 138 of the locking collar 134 and the outwardly facing surface 140 of the split ring 132. In accordance with the preferred embodiment of the invention shown in FIG. 3, the abutment surface 138 and the outwardly facing surface 140 are frustoconical in form having a conical angle of less than 90° from the horizontal, preferably 15° to 75° from the horizontal, more preferably 30° to 60° from the horizontal. It will be understood that the abutment surface 138 and the outwardly facing surface 140 may also be at an angle of 90° from the horizontal.

Figure 5:
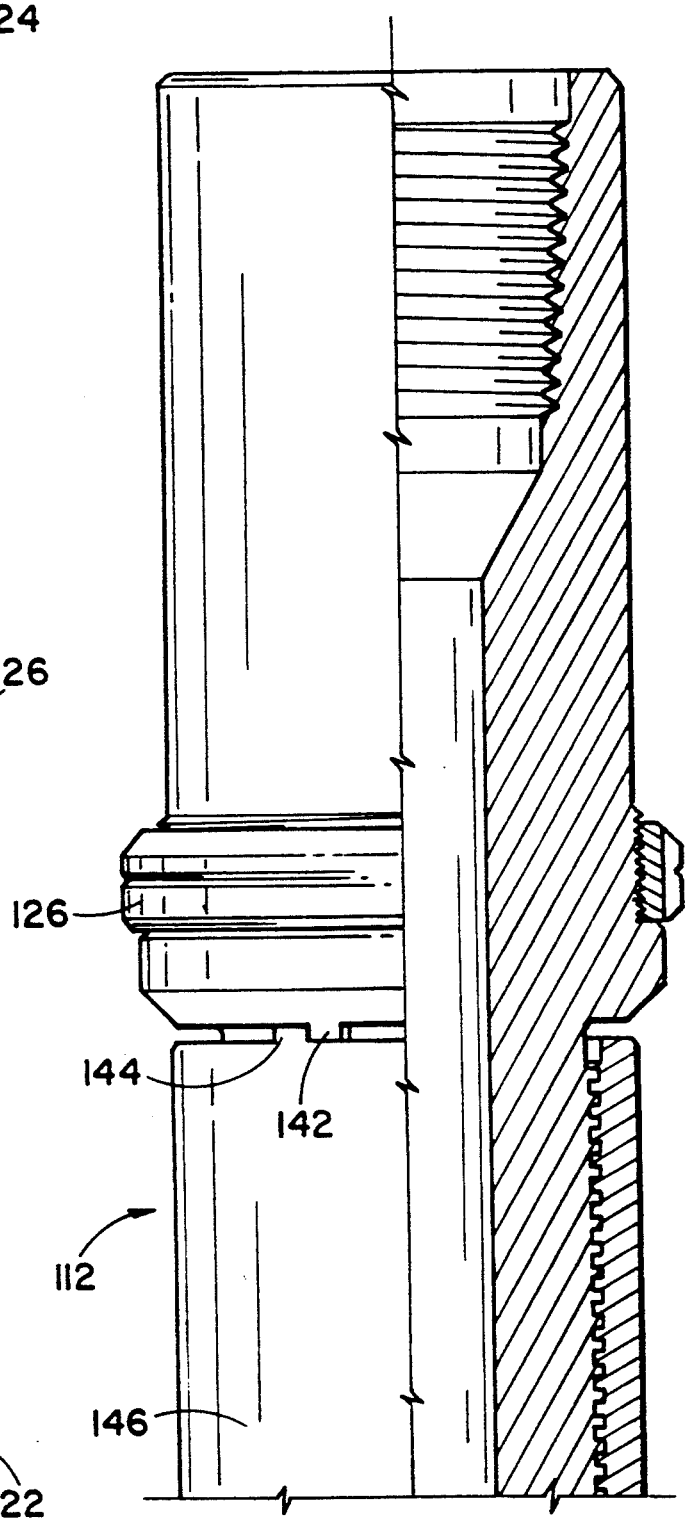
FIG. 5 is a side elevational view in partial cross section illustrating the improvements in the interconnection of the valve-actuating subassembly in accordance with the present invention.

In accordance with another aspect of the invention shown in FIG. 5, the additional torque tightening between the valve-actuating sub assembly 26 within the temporary abandonment safety valve 12 (FIG. 4) is avoided by providing a valve-actuating subassembly 126 (FIG. 5) with rotational stop means such as a lug 142 which engages a corresponding lug 144 on the lower portion 146 of the temporary abandonment safety valve 112. It will be understood that while only one pair of lugs is shown in the drawing, multiple lugs may be spaced circumferentially around the area of interconnection between the valve-actuating subassembly 126 and the lower portion 146 of the temporary abandonment safety valve 112.

It can be clearly seen that either alone or in combination, the improved locking coupling member shown in FIG. 3 and the torque limiting means shown in FIG. 5 act in concert to assure that upon left hand rotation, the only portion of the packer and valve assembly which disconnects is the desirable disconnection of the valve-actuating subassembly 26, 126 from the temporary abandonment safety valve 12, 112.

The foregoing description of the invention has included mention of certain thread hands and rotational directions. It will be understood by those skilled in the art that opposite thread hand and rotational movement for all parts would also be effective in accordance with, and within the scope of, the present invention.

While the invention has been described in the more limited aspects of preferred embodiments thereof, other embodiments have been suggested and still others will occur to those skilled in the art upon a reading and understanding of the foregoing specification. It is intended that all such embodiments be included within the scope of this invention as limited only by the appended claims.

Having thus described our invention, we claim:

1. In a packer assembly for the temporary abandonment of a well which assembly is set by rotation in a first direction and retrieved by rotation in a second direction opposite said first direction and including a threaded connector mandrel having threads in a first thread hand and threaded connector means for connecting said threaded connector mandrel of said packer assembly to a valve assembly having matching threads in said first thread hand, the improvement which comprises circumferential groove means on an outer cylindrical surface of said mandrel for receiving a retainer ring within said groove means and extending radially outwardly into compressive engagement with a locking collar means having threads of a second thread hand opposite said first thread hand in coupling engagement with matching threads of said second thread hand on said connector means.

2. The improvement as set forth in claim 1 wherein said retainer ring has a frustoconical outer surface.

3. The improvement as set forth in claim 2 wherein said frustoconical outer surface has a conical angle of 15 to 75 degrees.

4. The improvement as set forth in claim 2 wherein said frustoconical surface has a conical angle of 30 to 60 degrees.

5. In a packer and valve assembly for temporary abandonment of a well, which assembly is set by rotation in a first direction and retrieved by rotation in a second direction opposite to said first direction and including a threaded connector mandrel having threads in a first thread hand and threaded connector means for connecting said threaded connector mandrel of said packer assembly to a valve assembly having matching threads in said first thread hand, said valve assembly including a lower valve portion and a threaded valve-actuating subassembly maintaining said lower valve portion in an open position when said threaded valve-actuating subassembly is in place and allowing said lower valve portion to move into a closed position upon rotation in said second direction to remove said threaded valve-actuating subassembly, the improvement which comprises groove means for receiving a retainer ring on an outer cylindrical surface of said mandrel, a retainer ring within said groove means extending radially outwardly into compressive engagement with locking collar means having threads of a second thread hand opposite said first thread hand in coupling engagement with matching threads of said second thread hand on said connector means and stop means on said threaded valve-actuating subassembly and said lower valve portion, said stop means limiting relative rotation of said subassembly and lower valve portion upon rotation in said first rotational direction.

6. The improvement as set forth in claim 5 wherein said retainer ring has a frustoconical outer surface.

7. The improvement as set forth in claim 6 wherein said frustoconical outer surface has a conical angle of 15 to 75 degrees.

8. The improvement as set forth in claim 6 wherein said frustoconical surface has a conical angle of 30 to 60 degrees.

9. In a valve assembly for temporary abandonment of a well which valve assembly comprises a lower valve portion and a threaded valve-actuating subassembly maintaining said lower valve portion in an open position when said threaded valve-actuating subassembly is in place and allowing said lower valve portion to move into a closed position upon rotation in a first, removal direction to remove said threaded valve-actuating subassembly, the improvement which comprises stop means comprising longitudinally abutting lugs on each of said threaded valve actuating subassembly and said lower valve portion, said stop means limiting relative rotation of said valve-actuating subassembly and said lower valve portion in a second, makeup rotational directional.

* * * * *